US009394745B2

(12) United States Patent
Bayliss et al.

(10) Patent No.: US 9,394,745 B2
(45) Date of Patent: Jul. 19, 2016

(54) ROTARY STEERABLE TOOL ACTUATOR TOOL FACE CONTROL

(75) Inventors: Martin Thomas Bayliss, Gloucestershire (GB); Edward Charles Langden Richards, Warwickshire (GB); Christopher Wallwork, Malakoff (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 655 days.

(21) Appl. No.: 13/811,278

(22) PCT Filed: Apr. 21, 2011

(86) PCT No.: PCT/IB2011/001481

§ 371 (c)(1),
(2), (4) Date: Apr. 25, 2013

(87) PCT Pub. No.: WO2011/158111

PCT Pub. Date: Dec. 22, 2011

(65) Prior Publication Data

US 2013/0199844 A1 Aug. 8, 2013

Related U.S. Application Data

(60) Provisional application No. 61/356,476, filed on Jun. 18, 2010.

(51) Int. Cl.
*E21B 44/00* (2006.01)
*E21B 7/06* (2006.01)

(52) U.S. Cl.
CPC .. *E21B 7/06* (2013.01); *E21B 44/00* (2013.01)

(58) Field of Classification Search
CPC ..... E21B 44/00; E21B 44/005; E21B 7/064; E21B 34/066; E21B 47/024
See application file for complete search history.

(56) References Cited

U.S. PATENT DOCUMENTS

| | | | |
|---|---|---|---|
| 3,743,034 | A | 7/1973 | Bradley |
| 5,113,953 | A | 5/1992 | Noble |
| 5,685,379 | A | 11/1997 | Barr et al. |
| 5,695,015 | A | 12/1997 | Barr et al. |
| 5,706,905 | A | 1/1998 | Barr |
| 6,019,180 | A | 2/2000 | Pafitis et al. |
| 6,092,610 | A | 7/2000 | Kosmala et al. |

(Continued)

FOREIGN PATENT DOCUMENTS

| | | | |
|---|---|---|---|
| CN | 101443527 | A | 5/2009 |
| CN | 101657601 | A | 2/2010 |

(Continued)

OTHER PUBLICATIONS

First Examination Report for corresponding AU App No. 2011266774, Jan. 28, 2014, 3 pages .

(Continued)

*Primary Examiner* — Jennifer H Gay
*Assistant Examiner* — Steven MacDonald

(57) ABSTRACT

A technique facilitates controlling the direction of drilling when using a rotary steerable system to drill a borehole. The method comprises processing parameters related to operation of a rotatable collar of the rotary steerable system. The parameters are used in cooperation with characteristics of actuators to control the positioning of an actuator tool face which, in turn, controls the drilling orientation of the rotary steerable system.

18 Claims, 3 Drawing Sheets

(56) References Cited

U.S. PATENT DOCUMENTS

| | | | |
|---|---|---|---|
| 6,419,014 | B1 | 7/2002 | Meek et al. |
| 6,438,495 | B1 | 8/2002 | Chau et al. |
| 6,968,909 | B2 | 11/2005 | Aldred et al. |
| 7,559,379 | B2 | 7/2009 | Hall et al. |
| 7,600,586 | B2 | 10/2009 | Hall et al. |
| 7,610,970 | B2 | 11/2009 | Sihler et al. |
| 7,779,933 | B2 | 8/2010 | Sihler et al. |
| 7,798,246 | B2 | 9/2010 | Collins |
| 8,118,114 | B2 | 2/2012 | Sugiura |
| 8,590,636 | B2 | 11/2013 | Menger |
| 2003/0127252 | A1 | 7/2003 | Downton et al. |
| 2006/0157281 | A1 | 7/2006 | Downton |
| 2009/0032302 | A1 | 2/2009 | Downton et al. |
| 2011/0036632 | A1 | 2/2011 | Polynstev |
| 2011/0266063 | A1 | 11/2011 | Downton |
| 2012/0012396 | A1 | 1/2012 | Downton |
| 2012/0298420 | A1 | 11/2012 | Seydoux et al. |
| 2013/0000984 | A1 | 1/2013 | Menger et al. |
| 2013/0199844 | A1 | 8/2013 | Bayliss et al. |

FOREIGN PATENT DOCUMENTS

| | | | |
|---|---|---|---|
| GB | 2408757 | | 6/2005 |
| WO | 2009/002996 | | 12/2008 |
| WO | 20101043951 | A2 | 4/2010 |
| WO | 20121080812 | A2 | 6/2012 |
| WO | 20121080819 | A2 | 6/2012 |

OTHER PUBLICATIONS

Notice of Acceptance for corresponding AU App No. 2011266774, Dec. 16, 2014, 2 pages.

Decision to Grant for corresponding CN App No. 201180021715.X, Aug. 13, 2015, with partial English translation by Agent, 3 pages.

Office Action for corresponding CN App No. 201180021715.X, Mar. 13, 2015, with English translation by Agent, 5 pages.

Office Action for corresponding CN App No. 201180021715.X, Jun. 24, 2014, with English translation by Agent, 9 pages.

International Search Report for corresponding International App No. PCT/IB2011/001481, Nov. 10, 2011, 3 pages.

Written Opinion for corresponding International App No. PCT/IB2011/001481, Nov. 10, 2011, 4 pages.

ROTARY STEERABLE TOOL ACTUATOR TOOL FACE CONTROL

CROSS-REFERENCE TO RELATED APPLICATION

The present document is based on and claims priority to U.S. Provisional Application Ser. No. 61/356,476, filed Jun. 18, 2010.

BACKGROUND

Rotary steerable drilling systems for drilling deviated boreholes into the earth are generally classified either as point-the-bit systems or push-the-bit systems. In point-the-bit systems, the axis of rotation of the drill bit is deviated from the local axis of the bottom hole assembly in the general direction of the new portion of the hole being drilled. The borehole is propagated according to customary three-point geometry defined by upper and lower stabilizer touch points and the drill bit. The angle of deviation of the drill bit axis coupled with a finite distance between the drill bit and a lower stabilizer results in a non-collinear condition required for a curve to be generated. In this type of system, the drill bit tends to have less sideways cutting because the bit axis is continually rotated in the direction of the curved borehole.

In push-the-bit rotary steerable systems, there is usually no specially identified mechanism to deviate the bit axis from the local bottom hole assembly axis. Instead, the requisite non-collinear condition is achieved when either upper or lower stabilizers are used to apply an eccentric force or displacement in a direction oriented with respect to the direction of borehole propagation. Steering is again achieved by creating non co-linearity between the drill bit and at least two other touch points. In this type of system, the drill bit is required to cut sideways to generate the desired, curved borehole.

The forces applied to create the non-colinearity and to control the direction of drilling may be provided by a variety of actuators. The actuators provide a tool face oriented to act against a desired component, e.g. against a pivotable sleeve, in a manner that changes or maintains the desired non-collinear orientation of the rotary steerable drilling system. In many applications, difficulties can arise in controlling the actuator tool face in a manner to provide the desired control over the directional drilling.

SUMMARY

In general, the present invention provides a method for controlling the direction of drilling when using a rotary steerable system to drill a borehole. The method comprises processing parameters related to operation of a rotatable collar of the rotary steerable system. The parameters are used in cooperation with characteristics of actuators to control the positioning of an actuator tool face and thus to control the drilling orientation of the rotary steerable system.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a control technique for controlling the lateral movement of a rotary steerable system and thus the direction of drilling with respect to a borehole. For point and push the bit rotary steerable systems, a steering bias unit mechanism may comprise a sleeve articulated about a universal joint, as employed in a variety of rotary steerable systems. In one type of system, actuators react against an inside of the sleeve and an outside of a collar rotated during a drilling operation. Considering the sleeve as a free body, the points of contact with external objects are the bit, on-sleeve stabilizer, and the actuator(s) (and a strike ring when then sleeve is at full articulation). Both the stabilizer contact point with the formation and the actuator reaction point are behind the universal joint, i.e. on an opposite side of the joint relative to the drill bit.

For the sleeve to maintain a geostationary tool face as the collar rotates, the actuators need to be fired in the appropriate order and at the correct time to ensure the actuator force acts on the sleeve with the correct geostationary tool face. For the rotary steerable tool application envisaged for this algorithm, various actuators may be employed. Examples of suitable actuators able to act against the sleeve comprise solenoid operated valve actuators which open and close ports directing pressurized mud flow onto hinged actuator pads that transmit a force (due to conservation of momentum of the mud flow) against the inside of the sleeve. The whole actuator assembly, including the solenoid, valve and pad may be referred to as a bi-stable valve actuator, in light of the fact it is stable in two states, either on (pad open) or off (pad closed). According to one embodiment, an actuator tool face control algorithm is employed to control the actuator tool face, and an assumption may be made that a perfect collar position and speed estimate is available.

Figure 1:
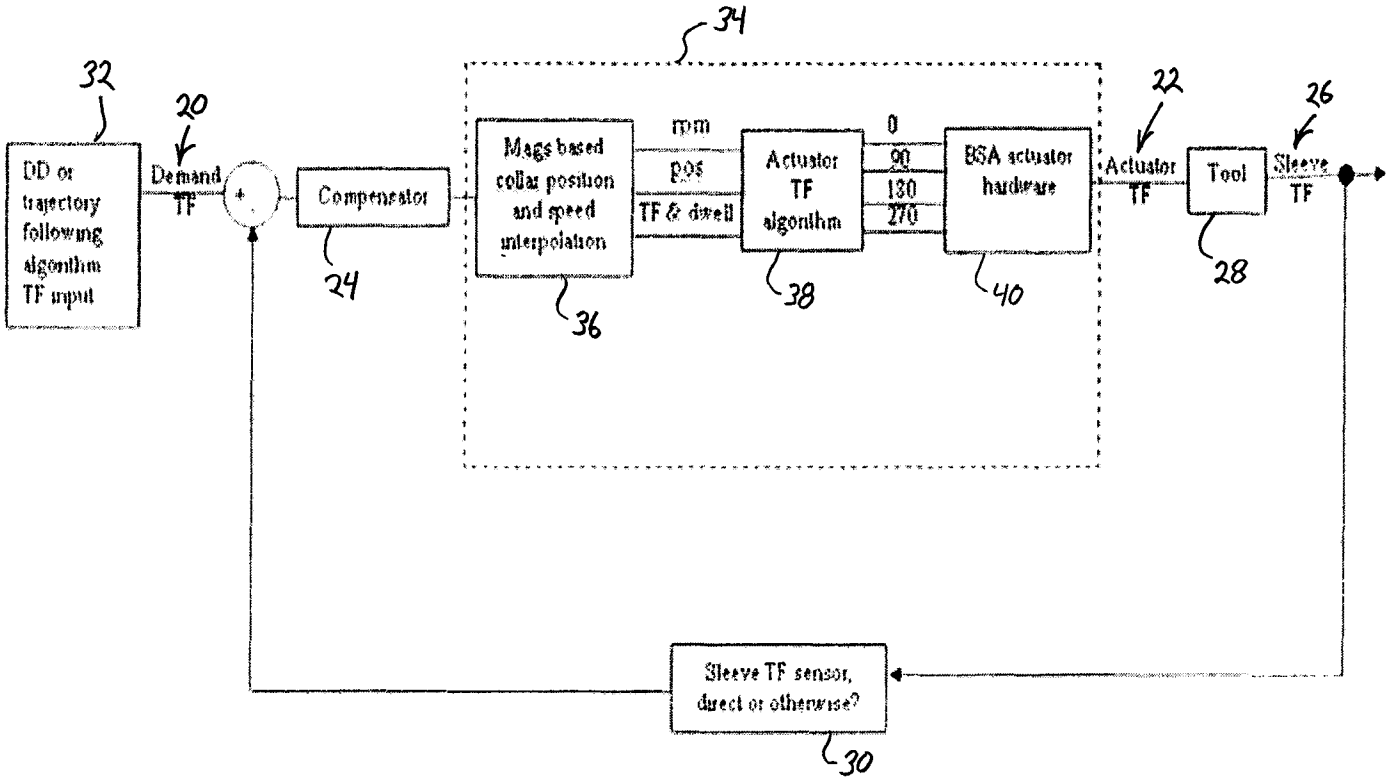
FIG. 1 is a general tool face control schematic, according to an embodiment of the present invention.

Referring generally to FIG. 1, a general tool face control schematic is illustrated. In this example, three separate tool faces have been defined in which a demand tool face (DTF) 20 is input from the outer trajectory control loop, manual or active. An actuator tool face (ATF) 22 is a response to the input tool face demand from a tool face compensator 24 (manual or active). Additionally, a sleeve tool face (STF) 26 may be defined as the actual response tool face of a tool 28, e.g. a rotary steerable tool sleeve, as sensed by a sleeve sensor 30, if present. The sleeve sensor 30 may monitor the sleeve/tool 28 directly or indirectly and relay data back to compensator 24, as illustrated. By way of example, the sensor 30 may be used to monitor the relative orientation or angle of the sleeve with respect to the collar.

The actuator tool face 22 may be a control open loop having for its demand tool face 20 a desired input, as represented by block 32. The desired input may comprise, for example, either directional driller commands or commands derived from inclination, azimuth or hold the line controllers. The desired input is relayed to compensator 24 and on to an actuator tool face controller 34 which processes a variety of parameters to facilitate control of the actuator tool face 22. By way of example, the parameters may comprise inputs such as a collar angular position estimate and a collar angular rate estimate, as represented by block 36. In some applications, a set of algorithm parameters also may be loaded as constants in the downhole tool software. The various parameters/inputs are processed according to the desired actuator tool face algorithm 38 and output to the appropriate actuator hardware 40, such as bi-stable valve actuator hardware (if the actuators comprise bi-stable valve actuators). The demand tool face 20 and collar parameters (and possibly additional parameters) are used by the actuator tool face controller 34 to control the firing order of the actuators, e.g. bi-stable valve actuators, for a given collar speed and position estimate.

For example, based on a collar position estimate and other variables, the algorithm 38 is employed to evaluate the on and off angular tool face firing angles at which each of the actuators is triggered. According to one embodiment, the algorithm is used to evaluate on and off angular tool face firing angles at which each of four bi-stable valve actuators is triggered. Examples of variables employed comprise target tool face angle, tool face dwell angle (symmetrical angle interval either side of target angle), firing angle tolerance, and the assumed switching time of the bi-stable valve units.

Figure 2:
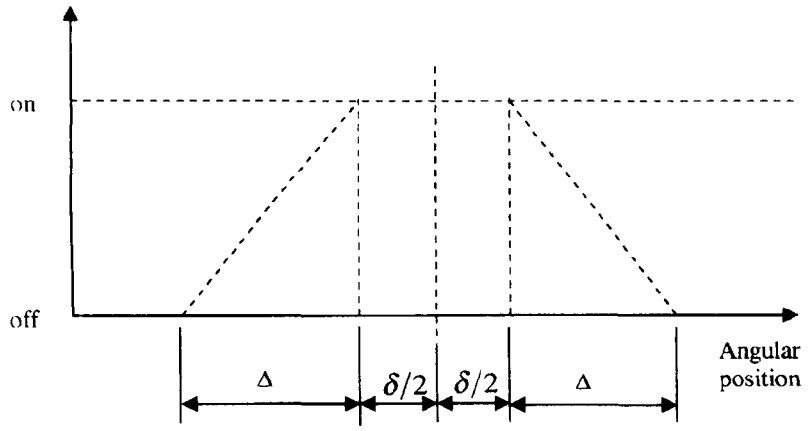
FIG. 2 is a graphical representation illustrating the triggering and response of bi-stable actuators relative to a collar angular position of a rotating collar of a rotary steerable system, according to an embodiment of the present invention.

The switching of the actuators between off and on states is illustrated graphically in FIG. 2 which shows a bi-stable valve collar angular position triggering graph. Referring again to FIG. 2, actuation of a single bi-stable valve unit is illustrated in which the x-axis represents angular collar position and the y-axis represents the binary on/off states of the bi-stable valve. As apparent from the graph, it has been assumed at the instantaneous collar rpm the collar rotates an angular interval $\Delta$ whilst the bi-stable valve is transitioning from the off to the on state. It also can be seen that the algorithm aims to have the bi-stable valve actuator "on state" angular interval symmetrically centered on the target angle with a dwell angular interval $\delta$. Once the bi-stable valve has remained in the on state for the full angular dwell interval $\delta$, the bi-stable valve is switched off and assumed to transition to the off state in the same time it took for it to transition from off to on. Hence, in terms of state transition angular interval $\Delta$, dwell angle interval $\delta$ and target angle $\theta$, the on and off target angular positions can be stated as:

$$On=\theta-\Delta-\delta/2$$

$$Off=\theta+\delta/2$$

The dwell angular interval will be independent of collar speed (other than to be optimized off line in terms of bi-stable valve performance in relation to collar speed), whereas the on to off bi-stable valve angular interval will vary directly as a function of collar rpm. This relationship may be expressed as follows:

$$\Delta=(RPM/60)\tau 360$$

where $\tau$ is the on to off response time of the bi-stable valve and $\Delta$ has units of degrees for the expression given.

Figure 3:
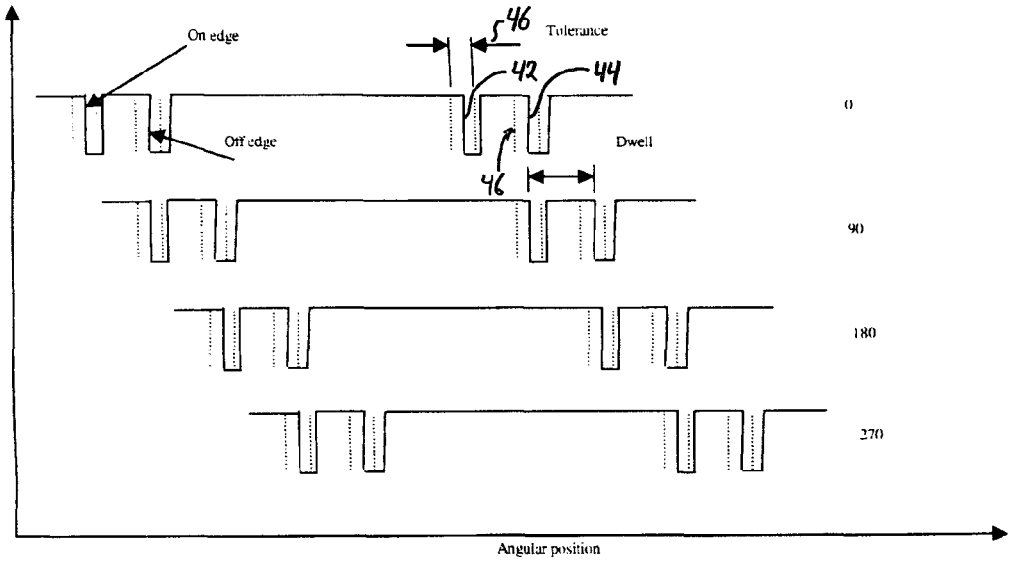
FIG. 3 is a graphical representation of four phase bi-stable firing signals used to control the bi-stable actuators, according to an embodiment of the present invention.

Hence, at any instant (given the angular collar speed), the on and off triggering angular positions are evaluated. By use of, for example, latched logic a falling edge 42, 44 is triggered at an angular tolerance 46 (to allow for hysteresis) about the computed on or off firing collar angle, as illustrated in FIG. 3. FIG. 3 graphically illustrates four phase bi-stable firing signals at 0, 90, 180 and 270 degrees. For each bi-stable valve the actuator algorithm works in exactly the same way except the on (42)/off (44) falling edge triggers are phased at 0, 90, 180 and 270 degrees. For a constant collar rpm, the bi-stable valve firing logic for all four bi-stable valves may be summarized as shown in FIG. 3.

In at least some of the embodiments described herein, the control system comprises a quadrature based interpolation on line signal conditioning of the radial tool face control sensor signals in order to gain match and remove the sensor biases on the quadrature radial tool face control signals. By way of further explanation and according to at least one embodiment of the present invention, implementation of the tool face control of a strap down tool involves an accurate collar position measurement in order to control the timing of the bi-stable actuator firings. This may be achieved by taking the arctangent of two quadrature signals, obtained from radially oriented pairs of magnetometers rotating with the collar. A consideration with respect to accuracy of the angular position measurement obtained in this way is the degree to which the pair of quadrature signals (necessarily sinusoidal due to collar rotation) are bias free (centered on zero signal) and gain matched (both having equal magnitude amplitudes). In practice, (usually due to noise and limitations in sensor quality—often driven by cost), the raw quadrature signals are poorly gain matched and have differing dc offsets.

Fortunately, with strap down rotary steerable system (RSS) drilling tools the following simple algorithm can be used to both strip out dc biases and gain match the quadrature signals. The algorithm, e.g. algorithm 38, operates on line and is split into two phases. The first phase removes the dc biases from each quadrature signal. The second phase then normalizes both quadrature signals, and hence gain matches them, so that both are dc bias free unit amplitude sine waves at quadrature. The arctangent of the two quadrature unit amplitude sine waves is then taken to obtain the collar angular position. For phase one, the dc bias is evaluated by identifying the maximum and minimum peak amplitude of each of the quadrature sine waves, then the dc offset correction for each of the sine waves is simply taken as half the sum of the absolute value of their maximum and minimum values, with this computed offset correction subtracted from the signals and so centering them on zero signal. One aspect of the algorithm for evaluating the maximum and minimum sine wave amplitudes used by the algorithm is a search sub-algorithm that recursively checks the instantaneous signal value against stored maximum or minimum values and updates these values if they are exceeded by the instantaneous signal.

To allow for slow variation in the quadrature signal amplitude, a per sample decay factor (close to unity but not exactly unity, with the decay factor value being related to the update rate of the search algorithm) is applied to the stored maximum or minimum values per update period. This adaptive search algorithm therefore assumes the signal amplitude variation over one period of the base quadrature signal period is not significant. For phase two, to normalize the two quadrature signals the evaluated sine wave amplitude for each quadrature sine wave (the dc bias corrected maximum signal value) is simply divided into the dc bias corrected signal, so normalizing it. Using the algorithm described above, it is possible to accurately measure the collar angular position using low cost non-survey quality magnetometers for strap down RSS tools.

Accordingly, the present invention may comprise a sub-algorithm of algorithm 38 that enables the evaluation of an angular collar position estimate for the tool face actuator firing timing algorithm 38 based on quadrature signal processing of low cost, poorly gain matched and dc bias offset magnetometer transducers (where the combination of the low cost magnetometer transducers and the associated signal quadrature processing constitutes the angular collar position sensor). The overall actuator tool face control algorithm principle is scalable in terms of the number of bi-stable actuators included in the overall tool face control actuator and could equally work for 1, 2, 3, 4 or more bi-stable actuators.

If the actuators employed are, for example, bi-stable solenoid actuators, the algorithm 38 also may be designed to compensate for or address certain actuator characteristics. For mechanical and electrical reasons, bi-stable solenoid actuators can fire erratically at low and high speed switching rates associated with tracking very low and very high collar rpm speeds which may occur down-hole due to the rotary steerable system drilling tool phenomena of stick slip. Therefore, certain embodiments of the tool face control algorithm 38 include under and over speed modes whereby if the collar speed drops below or rises above threshold rpm values (e.g. 30 and 400 rpm, respectively, although a variety of other threshold values may be employed), the algorithm ignores the collar position and speed estimates and simply fires/actuates the bi-stable solenoid actuators as if the collar were running at a steady rpm rate within the operating specification (e.g. 60 and 360 rpm, respectively, although a variety of other specified rotational rates may be selected).

Consequently, this embodiment of the control system always operates so the bi-stable solenoid actuators are switching in a controlled manner and erratic bi-stable solenoid actuator switching is avoided to prevent excessive power draw and possible system shut down. To prevent the system from hunting between normal and over/under speed modes, hysteresis is included on the threshold rpm values at which the over and under speed modes engage and disengage by simply making the collar rpm threshold value at which over or under speed mode engages different than the threshold collar rpm value at which it disengages. The collar rpm triggered under speed mode also has the advantage that it provides the tool with an auto-shallow hole test mode whereby if the tool is powered up but not rotating the tool automatically goes into under speed mode and fires/actuates the bi-stable solenoid actuators as if the tool were rotating at a steady speed, e.g. 60 rpm or another suitable speed. This capability is helpful for performing surface shallow hole tests in the field to check for basic system functionality prior to inserting the tool into the well.

The auto under or over speed mode also has advantages from a tool steering point of view in that the actuator tool face in either of these modes cycles (nutate) as if the tool were in the neutral steer phase at a cycle rate equal to the difference between the actual collar rpm rate and the collar rpm rate at which the bi-stable solenoid actuators are fired via the under or over speed mode. This tends to create the effect of making the tool steer a tangent to its instantaneous path, which is preferable to the tool propagation being completely out of control in an over or under speed event.

Accordingly, the algorithm 38 may employ over and under speed modes to avoid erratic bi-stable solenoid actuator switching. At threshold collar rpm values (with differing enable/disable values to apply switching hysteresis and thus avoid hunting between modes), the bi-stable solenoid actuators are fired as if the collar is rotating at a steady speed well within the operating specification of the tool. The under speed mode also provides the 'shallow hole test' mode which is useful in field test situations. Another benefit is that the over and under speed modes may be employed to ensure the tool steering is always under control with the tool drilling a tangent to its instantaneous path during an over or under speed event.

Figure 4:
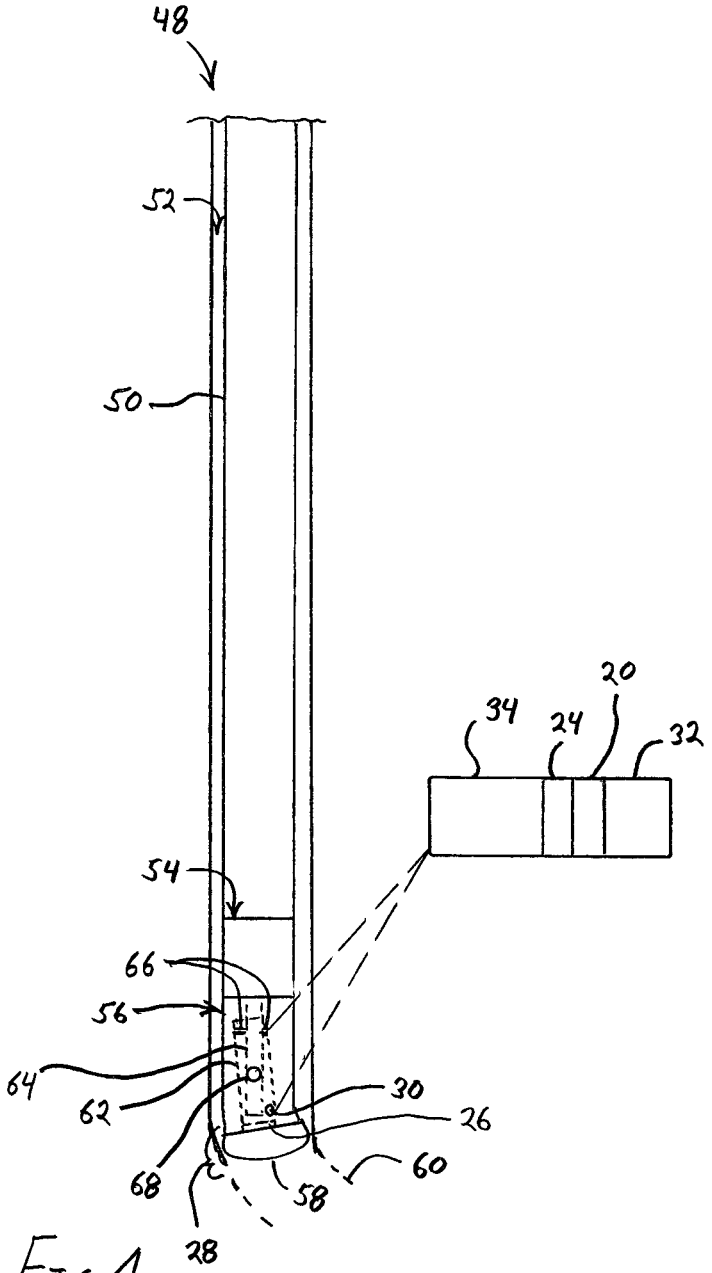
FIG. 4 is a schematic representation of a drilling system having a rotary steerable system controlled according to an embodiment of a control technique described herein, according to embodiment of the present invention.

Referring generally to FIG. 4 a drilling system 48 is illustrated and comprises an embodiment of the actuator tool face control system described above. In this example, the drilling system 48 comprises a drill string 50 deployed in a wellbore 52. The drilling system 48 is employed in a lateral wellbore or a multilateral wellbore drilling application. In this example, the drill string 50 comprises a bottom hole assembly 54 having a rotary steerable system 56 controlled by an embodiment of the actuator tool face control so as to direct a tool face associated with a drill bit 58 in drilling one or more lateral wellbores 60 along a desired path. By way of example, the rotary steerable system 56 may be a point-the-bit type rotary steerable system or other suitable system utilizing a sleeve 62 which is manipulated about a collar 64 to control the orientation of the sleeve tool face 26 (see FIG. 1) and hence the orientation of tool 28, e.g. sleeve 62/drill bit 58. As described above, sensor 30 may be employed to monitor the relative orientation or angle of the sleeve 62 with respect to the collar 64. Sensor 30 or additional sensors 30 also may be used to monitor the angular position and/or angular rate of collar 64. It should be noted that the drill string 50 also may incorporate stabilizers to facilitate formation of the desired curve during directional drilling.

The manipulation of sleeve 62 is performed by a plurality of actuators 66 which receive commands from the actuator tool face controller 34 following processing of the parameters employed to facilitate control of the actuator tool face 22, as described above. By way of example, actuators 66 may comprise bi-stable valve/solenoid actuators. The orientation of sleeve 62 and its sleeve tool face 26 may be achieved by articulating the sleeve 62 about a joint 68, such as a universal joint. Manipulation of sleeve 62 about joint 68 enables precise control over the orientation of the tool 28, e.g. sleeve 62/drill bit 58, and thus over the direction of drilling pursuant to operation of the control system as outlined above with reference to FIGS. 1-3.

Additional control system components may be removed, added or substituted; and the configuration and arrangement of components may be adjusted to suit a particular application. Furthermore, the control system algorithms and/or input parameters may be changed or adjusted to accommodate specifics of a given drilling operation.

Although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A method for controlling a drilling direction of a rotary steerable system having a rotatable collar and a sleeve pivoted by bi-stable valve actuators to control the drilling direction, comprising:

determining an angular collar speed of a rotary steerable system;

establishing a transition angle interval for each bi-stable valve actuator as each bi-stable valve is switched between off and on states; and using the angular collar speed and the transition angle of each bi-stable valve actuator to control a desired dwell angle interval for each bi-stable valve actuator.

2. The method as recited in claim 1, further comprising employing four bi-stable valve actuators positioned at 90° offsets with respect to the rotatable collar.

3. The method as recited in claim 2, wherein using comprises triggering on and off states of the four bi-stable valve actuators via latched logic with a desired angular tolerance.

4. The method as recited in claim 1, wherein determining comprises using an actuator tool face controller to process a plurality of inputs.

5. The method as recited in claim 4, wherein determining comprises processing a collar angular position estimate, a collar angular rate estimate, and a plurality of additional parameters.

6. The method as recited in claim 1, further comprising sensing a pivot position of the sleeve.

7. A method of controlling an actuator tool face in a rotary steerable system, comprising:

inputting a demand tool face;

estimating a collar angular position and a collar angular rate for processing by an actuator tool face controller; and determining firing times of a plurality of actuators used to control the actuator tool face based on the collar angular position, the collar angular rate, and selected parameters, wherein determining comprises processing variables including a switching time of the plurality of actuators.

8. The method as recited in claim 7, wherein determining comprises processing variables including a target tool face angle.

9. The method as recited in claim 7, wherein determining comprises processing variables including a tool face dwell angle.

10. The method as recited in claim 7, wherein determining comprises processing variables including a firing angle tolerance of the plurality of actuators.

11. The method as recited in claim 7, wherein determining comprises determining firing times of bi-stable valve actuators.

12. The method as recited in claim 11, wherein determining comprises determining firing times of four bi-stable valve actuators positioned at 90° offsets with respect to each other.

13. The method as recited in claim 7, further comprising firing the plurality of actuators to control a desired direction of drilling by manipulating the rotary steerable system.

14. The method as recited in claim 7, wherein estimating comprises using a sub-algorithm that enables evaluation of an angular collar position estimate for a tool face actuator firing time algorithm based on quadrature signal processing of poorly gain matched and dc bias offset magnetometer transducers.

15. The method as recited in claim 7, further comprising employing an actuator tool face control algorithm which is scalable with respect to the number of actuators included in a tool face control actuator.

16. A method of controlling an actuator tool face in a rotary steerable system, comprising:

inputting a demand tool face;

estimating a collar angular position and a collar angular rate for processing by an actuator tool face controller;

determining firing times of a plurality of actuators used to control the actuator tool face based on the collar angular position, the collar angular rate, and selected parameters, wherein determining comprises determining firing times of bi-stable actuators; and employing an algorithm to avoid erratic bi-stable actuator switching by utilizing automatic over and under speed modes such that at threshold collar rpm values the bi-stable actuators are actuated as if the collar is rotating at a steady speed within an operating specification of the tool.

17. The method as recited in claim 16, wherein employing comprises employing a shallow hole test mode of the algorithm in which the bi-stable actuators are automatically placed into an under speed mode in which the bi-stable actuators are actuated as if a tool were rotating at a steady rate even when the tool is not rotating.

18. The method as recited in claim 17, wherein employing comprises employing over and under speed modes to ensure tool steering is under control such that the tool drills a tangent to its instantaneous path during an over or under speed event.

* * * * *